US005244473A

United States Patent [19]

Sardessai et al.

[11] Patent Number: 5,244,473

[45] Date of Patent: Sep. 14, 1993

[54] PROCESS FOR MAKING MOISTURE RESISTANT BRIQUETTES

[76] Inventors: Kashinath S. Sardessai, 172 Friar La.; Thomas S. Pollok, 111 Clearview Dr., both of McMurray, Pa. 15317

[21] Appl. No.: 823,824

[22] Filed: Jan. 22, 1992

[51] Int. Cl.[5] ..... C10L 5/14

[52] U.S. Cl. ..... 44/553; 44/591; 44/592

[58] Field of Search ..... 44/553, 579, 387, 634, 44/551, 591, 592

[56] References Cited

U.S. PATENT DOCUMENTS

| | | | |
|---|---|---|---|
| 780,308 | 1/1905 | Schmidt | 44/579 |
| 2,567,136 | 9/1951 | Vloeberghs | 44/553 |
| 3,409,579 | 11/1968 | Robbins | 260/30.4 |
| 3,485,797 | 12/1969 | Robbins | 260/57 |
| 3,676,392 | 7/1972 | Robbins | 260/38 |
| 4,083,697 | 4/1978 | Smith et al. | 44/553 |
| 4,167,398 | 9/1979 | Hughes et al. | 44/557 |
| 4,236,897 | 12/1980 | Johnston | 44/553 |
| 4,586,936 | 5/1986 | Schäffer | 44/553 |
| 4,738,685 | 4/1988 | Goleczka et al. | 44/557 |
| 4,908,167 | 3/1990 | Beckmann et al. | 44/557 |

*Primary Examiner*—Margaret Medley

*Attorney, Agent, or Firm*—Cook, Egan, McFarron & Manzo, Ltd.

[57] ABSTRACT

A method is disclosed for bonding particles into briquettes wherein the particles to be briquetted are mixed with a phenolaldehyde resin and polyisocyanate in the presence of a catalyst, and the resulting mixture is briquetted. A phenolic-urethane polymer is formed to bond the particles and coat the briquette formed of said particles. Apparatus for carrying out the method is also disclosed.

3 Claims, 2 Drawing Sheets

PROCESS FOR MAKING MOISTURE RESISTANT BRIQUETTES

The present invention relates to a new process for making briquettes which are moisture free, moisture resistant, structurally sound, and abrasion resistant. The process is suitable for use with a wide range of materials to be briquetted and the resulting briquettes are suitable for a wide range of uses.

BACKGROUND OF THE PRESENT INVENTION

In the mining of minerals, water washing processes are often employed to separate the valuable constituents of mined materials from less useful constituents. These latter materials, often referred to as "tailings," have generally been regarded as waste because of the high cost associated with their being further beneficiated. They are usually discarded. One example of such discarded material is coal fines carried with effluent from coal washing operations.

Recent efforts to locate new energy sources have involved attempts at beneficiating these coal fines from effluent slurries. One approach has included the addition of binding agents to coal particles dried from the slurries. However, such techniques have proven to be only marginally, if at all, successful for many reasons, including that the finished product typically has a rather low heat content. Two principal reasons for this low heat content have been an inability to bond the coal particles in a moisture-free condition and an inability to sufficiently waterproof the finished product and to protect it against degradation during storage.

SUMMARY OF THE PRESENT INVENTION

The present invention involves mixing particles to be briquetted with synthetic resin systems and subsequently processing the mixture according to conventional briquetting techniques. An unexpected aspect of the invention is that the briquettes produced by this method can be made with a very low moisture content and are highly resistant to subsequent moisture sorption or weathering.

Thus, the present invention provides a valuable method for bonding and briquetting fine particles such as coal slurry, coke breeze, metallic particles such as iron powder, mill scales or other non-metallic fine particles. The briquettes so made are particularly useful because of the waterproofing and weather-resistant nature of the coating provided by the bonding agents for the beneficiated or non-beneficiated fine particles of metallic or non-metallic nature.

The following bonding agents are employed in the preferred embodiment of the present invention, and are prepared and mixed with particles to be briquetted:

- PART I Phenol-aldehyde resin (100 per cent or in solution with solvents);
- PART II Polymeric isocyanates (100 percent or in solution with solvents), which condense with phenol-aldehyde resin; and
- PART III Catalyst (100 per cent or in solution with solvents), for the condensation of phenol-aldehyde resin with polymeric isocyanate to form a thermosetting phenolic-urethane polymer.

The use of phenol-aldehyde resins, polymeric isocyanates and amine catalysts to make foundry sand cores and molds is known in the foundry art (Reference U.S. Pat. Nos. 3,676,392 and 3,409,579). In this process foundry sand is mixed in mixers with an appropriate amount of phenol-formaldehyde resin, polymeric isocyanate and amine catalyst. U.S. Pat. No. 3,485,797 discloses processes for making phenol formaldehyde resins, and is incorporated herein by reference. The resulting mixture is poured in appropriate pattern boxes to give the desired shape to cores and molds on curing.

However, one of the distinct disadvantages of this process is that the final shaped products (cores and molds) are highly susceptible to moisture. In a high humidity atmosphere, the breakage of these cores and molds can be very high and undesirable.

Use of the present invention in the context of briquetting provides several new and improved dimensions over such shaped products. One of the more surprising and valuable properties provided by the present invention is to provide a moisture resistance property to the finally shaped briquetted article. This is particularly advantageous in the basic metals industry due to the fact that the elimination of moisture allows the product to be charged totally dry, thereby eliminating the hazards associated with charging of wet materials into the melting vessels. This is an important factor.

As mentioned above, the briquetting step according to the present invention yields briquettes that are completely resistant to moisture. Indeed, a briquette of coal fines or metal fines made by the process of this invention can be left in a jar full of water for months without undergoing any deterioration or breakage of the briquette. The briquette stays intuct in its original shape.

Although not bound by any theory, the advantages of the present invention may be derived through a surprising occurrence in the course of the briquetting step. It has been observed that as the mixture of particulate and bonding agent is being briquetted under pressure and without any external heat, some of the thermosetting phenolic-urethane polymer being formed exudes out onto the briquette surface and forms a thin thermosetting film. This phenolic-urethane thermosetting polymer film imparts excellent waterproofing and weatherproofing characteristics to the briquettes, whether made from coal fines, metallic, or non-metallic particles. Moreover, the cured polymer-coated briquette has high tensile strength and resists crushing on stacking and fracturing on falling or other handling.

The characteristics of the briquettes formed according to the present invention also provide a desirable solution to some serious environmental problems. For example, many a types of dust which pollute the atmosphere, such as that of iron, arc furnace, fly ash of all types, coal fines, incinerator dust, metallic and non-metallic hazardous dust can be conveniently and efficiently briquetted and then either recycled or put to rest at federally approved dump sites following the federal regulations.

DETAILED DESCRIPTION OF THE PRESENT INVENTION

Figure 1:
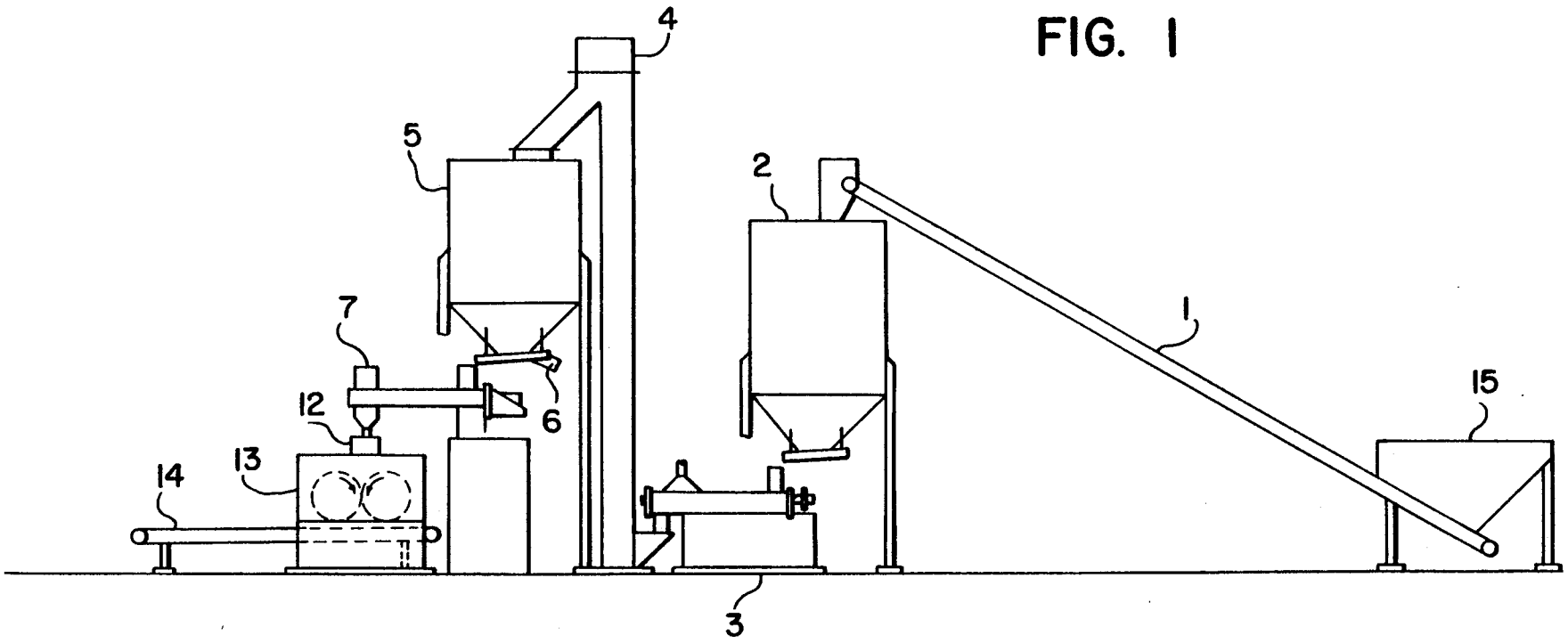
FIG. 1 is a schematic side view of a typical briquetting operation employing the present invention.

The preferred practice of the present invention is to use solvents for all the components (phenol-aldehyde resin polymeric isocyanates and catalyst) to lower the viscosity and provide mixability with particulate, thereby insuring easy mixing of the components with fine particulate and promoting a uniform mixture for subsequent briquetting operations. It is possible to use some or all of the components without solvents, provided the viscosity of the components is adequate to accomplish the required mixing to produce a uniform briquetting operation. If a solvent is employed, the particular type of solvent which is used is not critical, as long as the solvent is inert with respect to phenol-aldehyde resin and polymeric isocyanate. The solvent used may conveniently be a mixture of solvents for phenol-aldehyde resin as well as for polymeric isocyanate.

The preferred phenol-aldehyde resin is phenol-formaldehyde resole resin. Generally, the first step of the bonding process is mixing the required amount of phenol-formaldehyde resin (either 100 per cent or in solution with solvents) with particulate material, such as carbonaceous particles or metallic or nonmetallic particles. If desired, catalyst solution may be mixed with the particles at the same time the phenol-formaldehyde resin is admixed therewith. The phenol-formaldehyde resin and the catalyst can either be premixed with each other or else separately mixed with the particulate material sequentially, in either order. Next, an appropriate quantity of isocyanate (either 100 per cent or in solution with a solvent) is added to the mixture and mixed for a sufficient time to produce a uniform admixture with the particles. The preferred polymeric isocyanate for this invention is commercially available polymeric methane diphenyl isocyanate (MDI).

The particulate-bonding agent mixture is then briquetted with standard briquetting equipment, as is well known in the art, applying suitable briquetting pressure. Preferably, sufficient pressure is applied during briquetting to cause bonding agent to exude to the surface and form a protective film coating. No external heat need be added during the reaction or briquetting steps. The briquettes cure at room temperature or under the heat generated by the briquetting steps. The briquettes cure in the shape of the pattern of the briquetting equipment as the isocyanate reacts with the phenol-formaldehyde resin to give a uniform adhesive bonding between individual particles.

Hence, according a theory of the present invention, the pressure applied during the briquetting step performs a new and unexpected function in that it causes bonding agent to form a protective film. This film imparts a high degree of moisture resistance to the briquette, not found using other techniques.

Furthermore, the isocyanate reactants provide a moisture removal function in the system in addition to constituting a coupling reactant in the phenol-formaldehyde resin polymerization. Specifically, the isocyanates react with water to produce substituted carbamic acids which decarboxylate with ease to produce an amine. The amine reacts with isocyanate to give symmetrically substituted urea. The reactions are indicated as reaction 1 and 2, below. Hence, in the present invention the polymeric isocyanate used for bonding particulate plays a dual role, to remove moisture, by forming urea, and to form a coupling reactant in polymerization of the phenol-formaldehyde. This reduces the water content of the mixture and beneficiates the fine particulate, bonding them into a moisture free briquette.

Preferably, the organic chemicals resin system is added to the fine particulate material to a total percentage for all three chemicals of about 0.5 to 2 per cent, and up to 8 per cent or higher based on total weight of the raw materials. In a specific chemical mix wherein total phenol-formaldehyde resin and diisocyanate addition is 1 per cent of the weight of the raw material, 55 percent of the 1 percent is the phenol-formaldehyde resin and 45 percent of the 1 percent is the diisocyanate. The catalyst is about 0.5 percent to 10 percent of the resin weight. Thus, a typical chemical mix of 1 percent would be as follows:

Raw material weight =1 ton =2000 pounds

Total Chemical weight =1% =2000 ×0.01 =20 pounds

REACTION 1

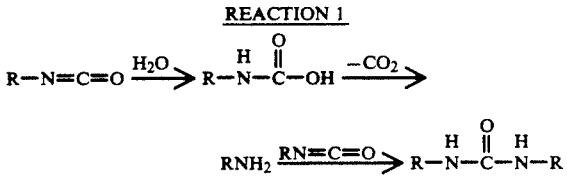

REACTION 2

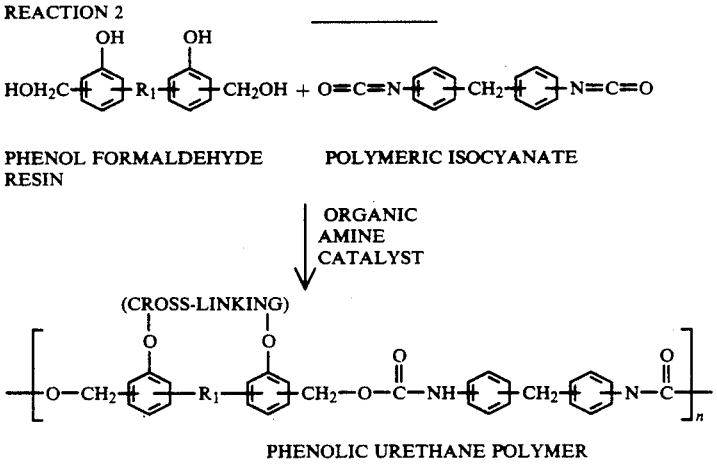

WHERE $R_1$ = $-CH_2-$ OR $-CH_2-O-CH_2-$

Phenol-formaldehyde resin weight =55%×20=11 pounds

Polymeric isocyanate weight =45%×20=9 pounds

Catalyst weight =3% of resin weight =3%×11=0.33 pounds

The percentage of phenol-formaldehyde resin varies for different end use applications. The percentage of catalyst can be chosen according to the desired set time, or polymerization time. In some cases the catalyst may be unnecessary as the chemistry of the particulate may eliminate the need to use the catalyst. Also, metals behave differently than carbonaceous particles.

PREPARATION OF RESIN SYSTEMS USED IN THE PROCESS

The following is description of the typical preparation of the resin systems used in the present invention.

PART I (phenol-formaldehyde): A previously weighed 3-necked flask is equipped with a stirrer, thermometer and condenser. To this flask is added stepwise:

1. Phenol (1 mole equivalent weight)
2. Paraformaldehyde (1.1 to 2 moles equivalent weight, depending on application)
3. Metal oxide catalyst like lead oxide (approximately 0.5 per cent based on weight of phenol).

The mixture is slowly heated at about the boiling point of water, and in reflux mode, until all the paraformaldehyde goes in solution. When a clear solution is obtained, the condenser is set in distillation mode. Heating is continued and the water is collected. When the temperature reaches about 230 degrees F., a check for free formaldehyde of the mix is taken. When the free formaldehyde of the reaction reaches 1.5%, vacuum is applied to the reaction mixture. The action is stopped when water ceases to distill. The contents of the flask will be the base phenolformaldehyde resin. In the next step, the base resin is preferably diluted with solvents. Part I is prepared by blending together:

Base resin---65 parts

Cellosolve acetate solvent---20 parts

SC 100 hydrocarbon solvent---15 parts.

PART II (polymeric isocyanate): Commercially available polymeric diisocyanate is blended with SC 100 hydrocarbon solvent to give 65to 80 percent solids, depending on application.

PART III: (catalyst) Commercially available phenyl propyl pyridine is blended with SC 100 hydrocarbon solvent to give 10 to 25 percent solids, depending on application.

TYPICAL PROCESS OF THE PRESENT INVENTION

FIG. 1 shows a schematic side view of typical apparatus used to process and briquette particles according to the present invention. Incoming particles to be briquetted are received in a receiving container 15. From there the particles are transported through a conveyor 1 to hopper 2. The bottom of hopper 2 contains a volumetric feeder which meters the fine particles to a counter flow heat exchanger 3 (a combination of heater and drier). Note, however, that this step may be eliminated if the fine particles are initially dry.

Figure 2:
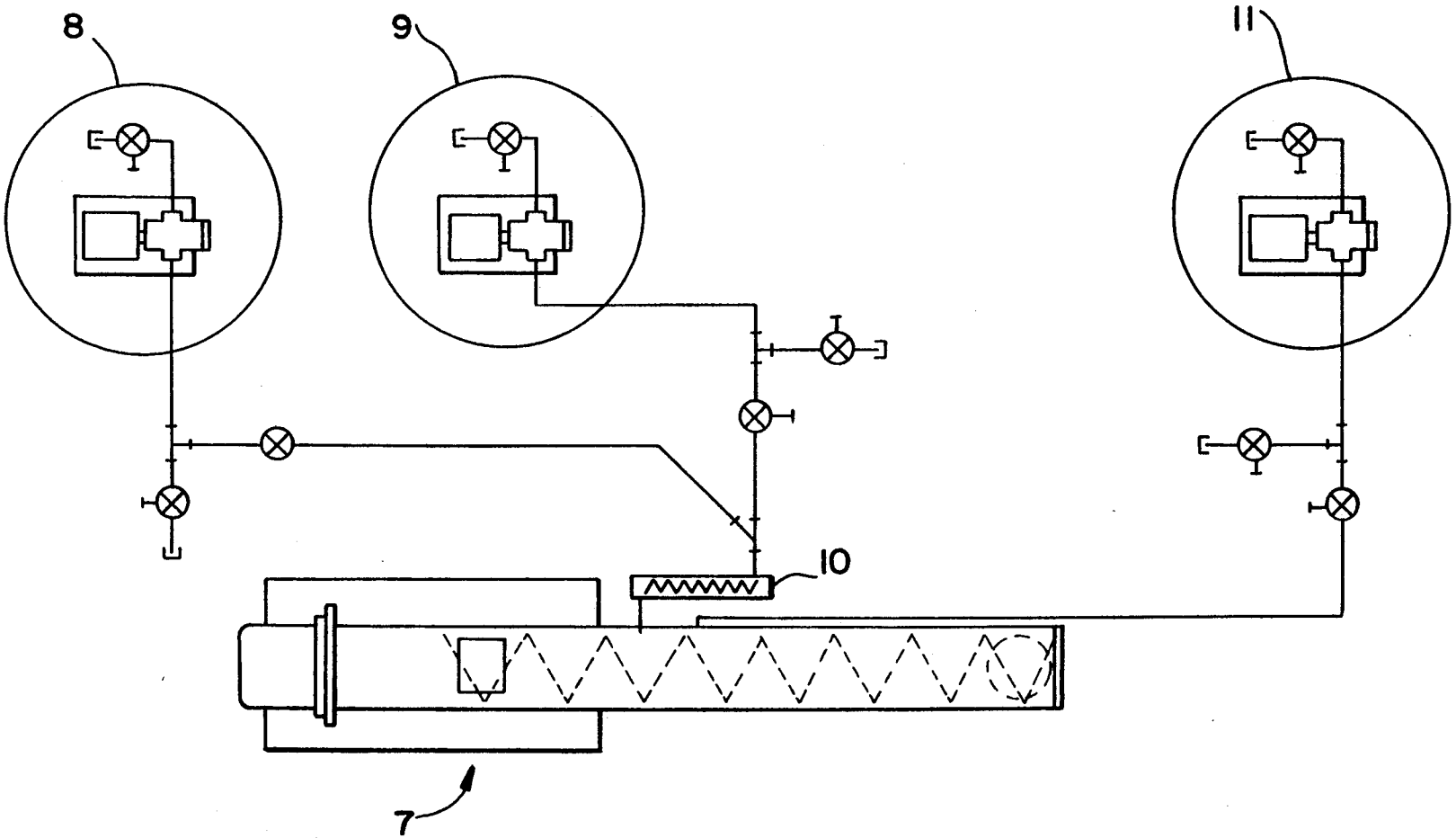
FIG. 2 is a schematic diagram of a high speed continuous mixer for combining and mixing resin, catalyst and particulate matter as in the present invention.

The particles are then conveyed through a bucket elevator 4 (or other conveying means) to a surge bin 5. The bottom of the surge bin 5 is equipped with a volumetric proportioning feeder 6 which meters material to a high speed continuous mixer 7. As shown schematically in FIG. 2, the high speed mixer 7 is equipped to receive the phenol-formaldehyde resin (Part I) from a delivery apparatus 8, and an appropriate amount of catalyst (Part III) is supplied from delivery apparatus 9. The phenol-formaldehyde and catalyst can then be premixed through a static liquid mixer 10. A calibrated amount of polymeric isocyanate is supplied through delivery apparatus 11 and further coats the mixture.

The whole coated and microencapsulated mix is then discharged into a feed screw 12, shown in FIG. 1, which is connected to a briquetter 13, as is well known in the art. From there, the microencapsulated coated mix (fine particles, phenol-formaldehyde resin, isocyanate and catalyst) is fed into the revolving briquetting rolls within briquetter 13. The briquetting rolls of briquetter 13 transform the microencapsulated mix, under pressure, into briquettes which fall on the conveyor 14, which conveys the finished product to an appropriate storage area.

As previously noted, the pressure applied during briquetting preferably causes bonding agent to exude out onto the surface of the briquette and form a protective layer or film.

The briquettes produced are moisture resistant and have excellent tensile and hot strength. Also, in the case of metals, the briquettes show good abrasion resistance.

The above is a typical example for briquetting coal fines, ferrous and nonferrous metal alloys and non-metallic fines. From the foregoing, it can be seen that a useful process for making moisture resistant briquettes has been provided which fully meets the objects of the instant invention. While the method has been described in the terms of a preferred embodiment, there is no intent to limit the invention to the same. On the contrary, it is intended to cover all modifications and equivalents within the scope of the appended claims.

We claim:

1. A briquette prepared from particles selected from the group consisting of coal, coke, and/or lignite, by mixing said particles with a phenolformaldehyde resin and a polyisocyanate in the presence of an organic nitrogen containing catalyst and continuously briquetting the resulting mixture to form a phenolic-urethane polymer bonded and coated briquette of said particles.

2. A fuel having stable, long burning characteristics comprising coal particles compressed into briquettes and bound together by phenolic-urethane polymer coating each of the said particles and the surface of briquettes by mixing said particles with a phenolformaldehyde resin and a polyisocynanate in the presence of an organic nitrogen containing catalyst.

3. A fuel comprising dried coal particles compressed into briquettes and bound together by mixing said particles with a phenol-aldehyde resin and a polyisocyanate in the presence of an organic nitrogen containing catalyst and continuously briquetting the resulting mixture to form a phenolic urethane polymer bonded and coated briquette of said particles.

* * * * *